US008794915B2

(12) United States Patent
Yamashita

(10) Patent No.: US 8,794,915 B2
(45) Date of Patent: Aug. 5, 2014

(54) BLOWER FAN

(75) Inventor: Takamasa Yamashita, Kyoto (JP)

(73) Assignee: Nidec Corporation, Kyoto (JP)

( * ) Notice: Subject to any disclaimer, the term of this patent is extended or adjusted under 35 U.S.C. 154(b) by 413 days.

(21) Appl. No.: 13/293,155

(22) Filed: Nov. 10, 2011

(65) Prior Publication Data

US 2012/0121407 A1 May 17, 2012

(30) Foreign Application Priority Data

Nov. 12, 2010 (JP) ..... 2010-253967

(51) Int. Cl.
*F04D 29/42* (2006.01)

(52) U.S. Cl.
USPC ..... 415/206; 417/423.14

(58) Field of Classification Search
CPC ..... F04D 29/4233; F04D 29/424
USPC ..... 415/206; 417/423.14; 361/695
See application file for complete search history.

(56) References Cited

U.S. PATENT DOCUMENTS 6,652,246 B1 * 11/2003 Lin et al. ..... 417/360
6,830,429 B2 12/2004 Hirata
8,342,799 B2 * 1/2013 Hwang et al. ..... 415/185
8,348,594 B2 * 1/2013 Chen ..... 415/102
8,491,261 B2 * 7/2013 Lin ..... 415/206

FOREIGN PATENT DOCUMENTS

JP 60-145497 A 7/1985
JP 2003-069265 A 3/2003

* cited by examiner

*Primary Examiner* — Ninh H Nguyen
(74) *Attorney, Agent, or Firm* — Keating & Bennett, LLP

(57) ABSTRACT

A blower fan includes a housing arranged to accommodate an impeller, wherein an upper surface portion of the housing includes a motor fixing portion, a peripheral portion, and a plurality of ribs interconnecting the motor fixing portion and the peripheral portion, the upper surface portion including a plurality of air intake ports defined between the motor fixing portion, the peripheral portion and the plurality of ribs being arranged to oppose the impeller; and the peripheral portion includes a peripheral low portion arranged to surround or substantially surround outer peripheries of the air intake ports and positioned lower than upper surfaces of the plurality of ribs and a peripheral high portion provided with rib extension portions continuously extending from the plurality of ribs and positioned higher than an upper surface of the peripheral low portion.

18 Claims, 12 Drawing Sheets

BLOWER FAN

BACKGROUND OF THE INVENTION

1. Field of the Invention

The present invention relates to a blower fan.

2. Description of the Related Art

Japanese Patent Application Publication No. S60-145497 (JP60-145497A) discloses a conventional centrifugal blower for use in an air conditioner. As stated from line 11 of the upper right column to line 9 of the lower left column on page 2 and as shown in FIGS. 2 and 3 of JP60-145497A, the centrifugal blower includes a casing having a spiral surface 3. The radial length of the spiral surface 3 is increased from a spiral start point 7 radially closest to an impeller 1 along a rotation direction M of the impeller 1 in proportion to the rotation angle. An axial length F is constant in a section B extending from the spiral start point 7 to a first midpoint 8. A first slant surface 10 is formed in a section C extending from the first midpoint 8 to a second midpoint 9. In the section C, the axial length F is increased in proportion to the rotation angle. The axial length F is constant in a section D extending from the second midpoint 9 to a spiral end point 11. An inclination angle of a second slant surface 12 is increased to secure an equal cross-sectional area as the axial length is increased in proportion to the rotation angle. An inclination angle of a third slant surface 14 is changed to increase in a section E extending from the spiral end point 11 to a discharge midpoint 13. A flow path of a rectangular shape is enlarged at an appropriate enlargement angle in a section G leading to an outlet port 6. In lines 11 and 12 of the right lower column on page 2, JP60-145497A discloses that this configuration provides an increased flow path area and realizes enhanced blowing performance and reduced noise.

Japanese Patent Application Publication No. 2003-69265 (JP2003-69265A) is directed to a conventional small-size cooling fan for cooling an MPU of a notebook PC or the like. As recited in paragraph [0015] and as illustrated in FIGS. 1 and 3 of JP2003-69265A, the small-size cooling fan includes a rotating fan body 8 and a motor which are arranged within a flat fan housing 7. An air discharge port 9 is provided at one side of the fan housing 7. A backflow-preventing wind tunnel portion 10 leading to the air discharge port 9 is formed outwards of the tip ends of blades of the rotating fan body 8 in the fan housing 7. In paragraph [0018], JP2003-69265A discloses that, since an inner height of the wind tunnel portion 10 is set greater than an inner height of a fan chamber, a wind path of the fan is secured by the backflow-preventing wind tunnel portion 10 while the backflow of wind from the air discharge port 9 to the fan portion is prevented by the backflow-preventing wind tunnel portion 10 having a sharply increased space.

As one example of a conventional small-size cooling fan for use in a notebook PC, there is available a cooling fan in which an air intake port is provided around a motor fixing portion of a thin housing and an air discharge port is provided on a side surface of the housing. In this cooling fan, there are provided ribs for connecting the motor fixing portion to the portion around the air intake port.

In a notebook PC, the gap between an air intake port of a cooling fan and other members such as a PC housing, for example, is kept narrow. This makes it difficult to increase an air intake quantity and imposes a limitation in increasing an air blowing quantity. If the housing of the cooling fan is made thin to increase the gap, there is a possibility that the strength of ribs may be reduced and the requirements in a drop impact test cannot be complied with.

SUMMARY OF THE INVENTION

In view of the above, preferred embodiments of the present invention provide a blower fan arranged to increase an air intake quantity while also suppressing a reduction in the strength of a housing thereof.

Preferred embodiments of the present invention provide a blower fan that preferably comprises: an impeller rotatable about a center axis; a motor arranged to rotate the impeller about the center axis; and a housing arranged to accommodate the impeller; wherein the housing preferably includes an upper surface portion arranged to cover an upper surface of the impeller, a lower surface portion arranged to cover a lower surface of the impeller, and a side wall portion arranged to cover a side surface of the impeller and including an air discharge port; the upper surface portion preferably includes a motor fixing portion to which the motor is fixed, a peripheral portion positioned around the motor fixing portion and a plurality of ribs interconnecting the motor fixing portion and the peripheral portion, the upper surface portion including a plurality of air intake ports defined between the motor fixing portion, the peripheral portion and the ribs being arranged to oppose the impeller; and the peripheral portion preferably includes a peripheral low portion arranged to surround or substantially surround outer peripheries of the air intake ports and to be positioned lower than both of upper surfaces of the ribs and a peripheral high portion provided with rib extension portions continuously extending from the ribs that is positioned higher than an upper surface of the peripheral low portion.

With the blower fan in accordance with the preferred embodiments of the present invention, it is possible to increase an air intake quantity while also substantially suppressing any reduction in the strength of a housing.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

In the following description, the upper axial side along a center axis of a blower fan in FIG. 1 will be referred to as "upper" and the lower axial side as "lower". The "vertical direction" referred to herein is not intended to mean the vertical direction with respect to gravity when the blower fan is actually installed inside a device. The circumferential direction about the center axis will be referred to as "circumferential" and the radial direction with respect to the center axis as "radial".

Figure 1:
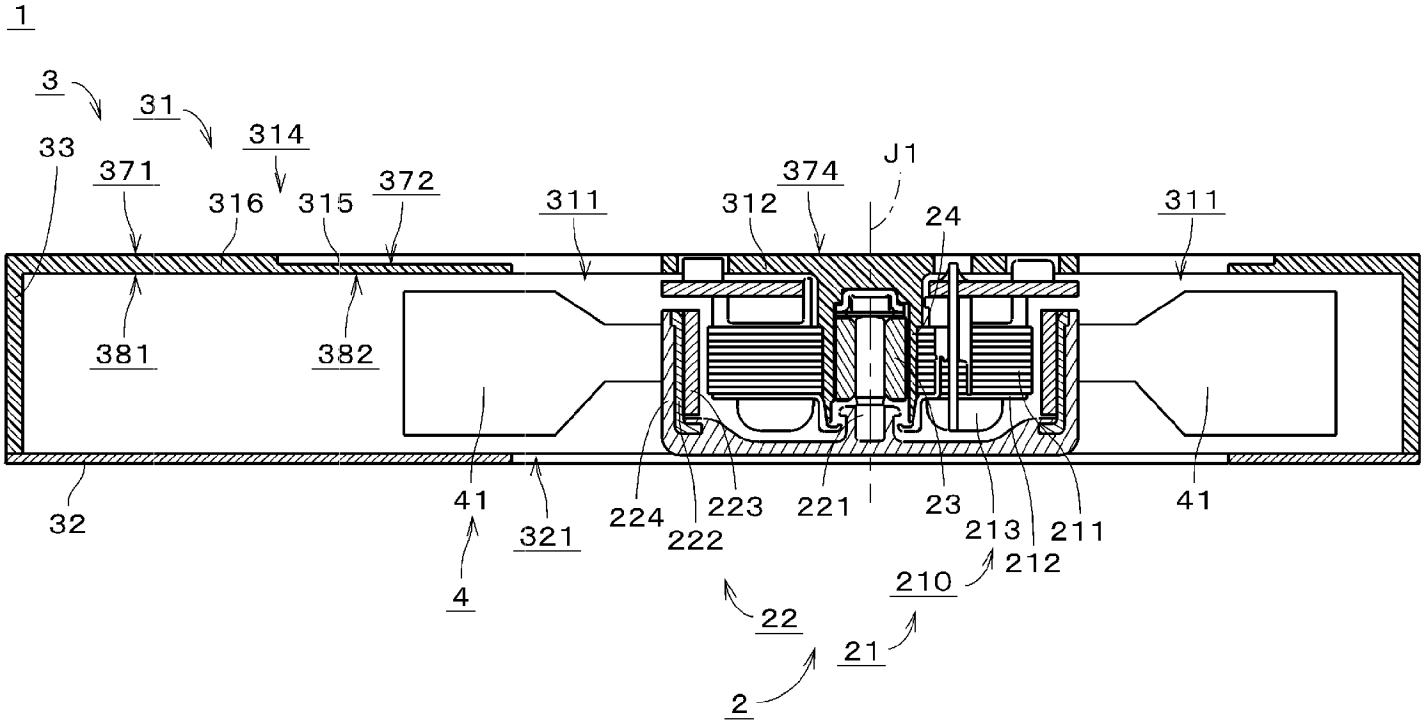
FIG. 1 is a section view showing a blower fan according to a first preferred embodiment.

FIG. 1 is a section view showing a blower fan 1 in accordance with a first preferred embodiment of the present invention. The blower fan 1, which is preferably a centrifugal fan, is mounted to, e.g., a notebook PC, and is used to cool components arranged within a casing of the notebook PC.

The blower fan 1 preferably includes a motor 2, a housing 3, and an impeller 4. The impeller 4 is arranged about a center axis J1 extending in the vertical direction. The motor 2 is arranged to cause the impeller 4 to rotate about the center axis J1. The housing 3 is arranged to accommodate the motor 2 and the impeller 4.

The housing 3 preferably includes an upper surface portion 31, a lower surface portion 32, and a side wall portion 33. The upper surface portion 31 is arranged to cover the upper side of the impeller 4 in FIG. 1. The lower surface portion 32 is arranged to cover the lower side of the impeller 4. The side wall portion 33 is arranged to cover the flank side of the impeller 4. The side wall portion 33 is preferably, for example, a resin member provided as a single monolithic piece with the upper surface portion 31. The lower surface portion 32 is attached to the lower end of the side wall portion 33.

Figure 2:
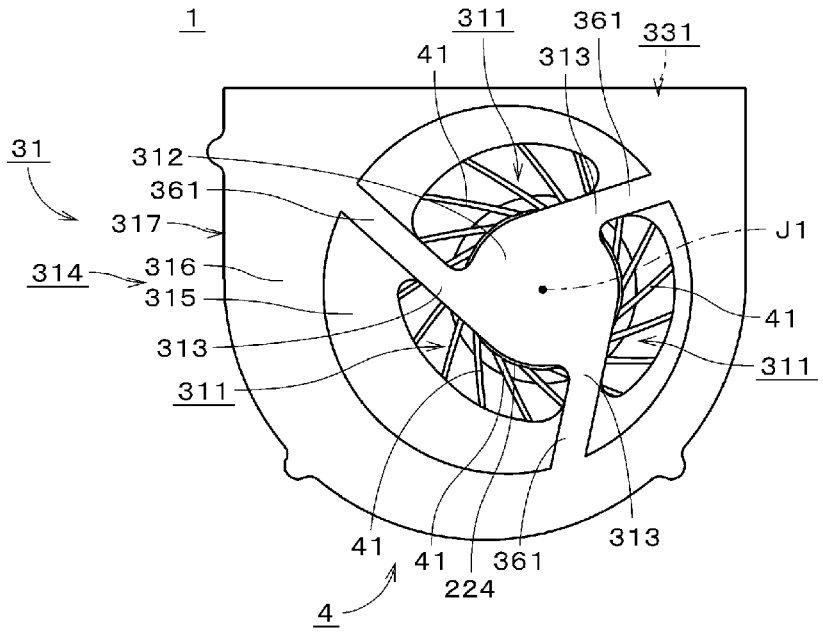
FIG. 2 is a top view of the blower fan.
Figure 3:
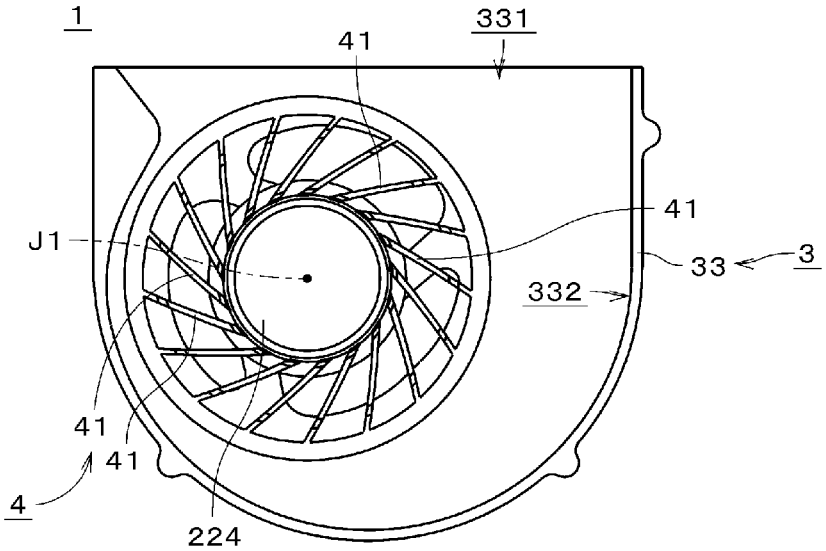
FIG. 3 is a bottom view of the blower fan.

FIG. 2 is a top view of the blower fan 1. FIG. 3 is a bottom view of the blower fan 1 with the lower surface portion 32 removed for clarity. As shown in FIGS. 1 and 2, a plurality of air intake ports 311 arranged to face the impeller 4 is defined in the upper surface portion 31. As can be seen in FIG. 1, an air intake port 321 arranged to face the impeller 4 is defined in the lower surface portion 32. In the following description, the air intake ports 311 and the air intake port 321 will be referred to as "upper air intake ports 311" and "lower air intake port 321", respectively. In the first preferred embodiment, three upper air intake ports 311 and one lower air intake port 321 are provided in the housing 3, however, any other number of upper air intake ports 311 and lower air intake ports 321 could be used if so desired. The lower air intake port 321 preferably has a substantially circular shape about the center axis J1. By providing the lower air intake port 321 in addition to the upper air intake ports 311, it becomes possible to easily increase the air intake quantity of the blower fan 1. As shown in FIG. 3, an air discharge port 331 extending along substantially the entire transverse width of the housing 3 is defined in the side wall portion 33.

The motor 2 shown in FIG. 1 is of an outer rotor type. The motor 2 preferably includes a stationary unit 21 as a fixed assembly and a rotary unit 22 as a rotating assembly. The rotary unit 22 is arranged to be supported by a sleeve 23 to rotate about the center axis J1 with respect to the stationary unit 21.

The stationary unit 21 preferably includes a stator 210 having an annular shape about the center axis J1. The stator 210 is attached to the outer surface of a sleeve holding portion 24 having a substantially cylindrical shape. The sleeve holding portion 24 protrudes downwards from the upper surface portion 31 of the housing 3. The stator 210 preferably includes a stator core 211, an insulator 212, and coils 213. The stator core 211 is preferably provided by laminating thin silicon steel plates one above another, however, any other desirable type of stator core could be used. The insulator 212 is an insulating body arranged to cover the surface of the stator core 211.

The rotary unit 22 preferably includes a shaft 221, a yoke 222, a rotor magnet 223, and a cup portion 224. The cup portion 224 preferably has a substantially cylindrical closed-bottom shape about the center axis J1. The cup portion 224 is opened upwards. The shaft 221 is arranged in a coaxial relationship with the center axis J1 and is fixed to the bottom of the cup portion 224. The yoke 222 has a substantially cylindrical shape about the center axis J1 and is fixed to the inner surface of the cup portion 224. The rotor magnet 223 has a substantially cylindrical shape about the center axis J1 and is fixed to the inner surface of the yoke 222.

The upper end portion of the shaft 221 is arranged to be inserted into the sleeve 23 having a substantially cylindrical shape about the center axis J1. The sleeve 23 is preferably provided by an oil-containing porous metal body, however, any other desirable type of bearing sleeve could be used. The sleeve 23 is inserted into, and fixed to, the sleeve holding portion 24. The sleeve 23 rotatably supports the shaft 221 about the center axis J1. Instead of the sleeve 23, it may be possible to use outer types of bearings, such as, for example, a ball bearing, an air bearing, a hydrodynamic bearing, etc.

As shown in FIGS. 1 through 3, the impeller 4 preferably includes a plurality of blades 41. The blades 41 are arranged on the outer surface of the cup portion 224 circumferentially about the center axis J1. The radial inner end portions of the blades 41 are arranged to be fixed to the outer surface of the cup portion 224. If an electric current is supplied to the stationary unit 21 shown in FIG. 1, a torque acting about the center axis J1 will be generated between the rotor magnet 223 and the stator 210. Thus, because of the torque, the impeller 4 is arranged to rotate together with the rotary unit 22 in a specified rotation direction about the center axis J1. Due to the rotation of the impeller 4, air is drawn into the housing 3 from the upper air intake ports 311 and the lower air intake port 321. Within the housing 3, the air flows from the rotational trailing side of the impeller 4 to the rotational leading side thereof and is discharged through the air discharge port 331 shown in FIG. 3.

In the first preferred embodiment, the impeller 4 preferably rotates counterclockwise in FIG. 3. In the following description, the left side of the center axis J1 in FIG. 3 will be referred to as "rotational trailing side of the impeller 4" and the right side of the center axis J1 in FIG. 3 will be referred to as "rotational leading side of the impeller 4". In FIG. 2, the right side of the center axis J1 is the rotational trailing side of the impeller 4 and the left side of the center axis J1 is the rotational leading side of the impeller 4. As can be seen in FIG. 3, the center axis J1 is arranged to be off-center from the center of the air discharge port 331 to the left side, i.e., to the rotational trailing side in the transverse direction along which the air discharge port 331 extends. The radial distance between an inner surface 332 of the side wall portion 33 and the outer edge of the impeller 4 at the rotational trailing side of the impeller 4 is preferably smaller than the radial distance between the inner surface 332 of the side wall portion 33 and the outer edge of the impeller 4 at the rotational leading side of the impeller 4. In the first preferred embodiment, the radial distance between the inner surface 332 of the side wall portion 33 and the outer edge of the impeller 4 is gradually increased from the rotational trailing side to the rotational leading side. There may be a section in which the radial distance remains constant.

As shown in FIG. 2, the upper surface portion 31 of the housing 3 preferably includes a motor fixing portion 312, a plurality of ribs 313, and a peripheral portion 314. The motor 2 (see FIG. 1) is arranged to be fixed to the lower surface of the motor fixing portion 312 through the sleeve holding portion 24. The motor fixing portion 312 preferably has a substantially circular shape when seen in a plan view. The peripheral portion 314 is positioned around the motor fixing portion 312. The ribs 313 interconnect the motor fixing portion 312 and the peripheral portion 314. In the first preferred embodiment, the number of the ribs 313 is preferably three, however, any other desirable number of ribs 313 could be used. The three ribs 313 are provided between the three upper air intake ports 311 circumferentially arranged to surround the outer periphery of the motor fixing portion 312. In other words, the three upper air intake ports 311 are defined between the motor fixing portion 312, the peripheral portion 314, and the ribs 313 adjoining to each other.

As shown in FIG. 1, the peripheral portion 314 preferably includes a peripheral low portion 315 and a peripheral high portion 316. An upper surface 371 of the peripheral high portion 316 is positioned higher than an upper surface 372 of the peripheral low portion 315, namely farther than the upper surface 372 of the peripheral low portion 315 from the impeller 4 in the direction of the center axis J1. A lower surface 381 of the peripheral high portion 316 and a lower surface 382 of the peripheral low portion 315 are preferably flush or substantially flush with each other in the direction of the center axis J1. In the peripheral portion 314, the peripheral high portion 316 is a thick portion and the peripheral low portion 315 is a thin portion. In the first preferred embodiment, the thickness of the peripheral high portion 316 is preferably about 1 mm to about 1.5 mm and the thickness of the peripheral low portion 315 is preferably about 0.5 mm to about 0.7 mm.

As shown in FIG. 2, the peripheral low portion 315 is arranged into a substantially annular shape so as to surround the outer peripheries of the three upper air intake ports 311. The peripheral low portion 315 is not provided at the radial outer portions of the three ribs 313, i.e., the portions of the three ribs 313 linearly extending radially outwards. In the upper surface portion 31, the radial width of the peripheral low portion 315 at the left side of the center axis J1 in FIG. 2 is greater than the radial width of the peripheral low portion 315 at the right side of the center axis J1. In other words, the radial width of the peripheral low portion 315 at the rotational leading side of the impeller 4 is greater than the radial width of the peripheral low portion 315 at the rotational trailing side.

The peripheral high portion 316 is arranged to surround the outer periphery of the peripheral low portion 315 and to continuously extend to the outer edge 317 of the upper surface portion 31. The peripheral high portion 316 preferably includes three band-shaped portions 361 continuously extending from the three ribs 313 (hereinafter referred to as "rib extension portions 361"). In other words, the peripheral high portion 316 extends from the ribs 313 to the outer edge 317 of the upper surface portion 31. The peripheral high portion 316 preferably includes the outer edge 317 of the upper surface portion 31 in its entirety. It goes without saying that the peripheral high portion 316 includes the entire portion of the outer edge 317 of the upper surface portion 31 arranged above the air discharge port 331.

As shown in FIG. 1, the upper surface 371 of the peripheral high portion 316 is flush or substantially flush with the upper surface 374 of the motor fixing portion 312 and the upper surfaces of the ribs 313. Thus, the upper surface 372 of the peripheral low portion 315 is positioned below the upper surface 374 of the motor fixing portion 312 and the upper surfaces of the ribs 313, namely closer to the impeller 4 in the direction of the center axis J1.

When the blower fan 1 is attached to the notebook PC, the upper surface portion 31 of the housing 3 is opposed to the inner surface of a casing of the notebook PC or other parts mounted within the notebook PC. The distance between the casing of the notebook PC and the upper surface portion 31 of the housing 3 is very small. In the blower fan 1, the peripheral portion 314 of the upper surface portion 31 includes the peripheral low portion 315 substantially surrounding the outer periphery of the upper air intake ports 311. Accordingly, it is possible to increase the distance between the upper surface portion 31 and the casing of the notebook PC in the vicinity of the upper air intake ports 311. Moreover, the total length of the edge of the peripheral high portion 316 facing toward the upper air intake ports 311 becomes longer. The opening area of the clearance between the edge of the peripheral high portion 316 facing toward the upper air intake ports 311 and the casing of the notebook PC makes it possible to reduce the resistance against the air flowing from between the peripheral high portion 316 and the casing of the notebook PC to the upper air intake ports 311. As a result, it is possible to increase the quantity of the air drawn through the upper air intake ports 311 and to increase the quantity of the air blown by the blower fan 1. That is, the blowing characteristics of the blower fan 1 can be improved.

In the peripheral portion 314, the upper surface 371 of the peripheral high portion 316 is positioned higher than the upper surface 372 of the peripheral low portion 315. Therefore, the strength of the peripheral high portion 316 is greater than the strength of the peripheral low portion 315. Since the peripheral high portion 316 employs a structure including the rib extension portions 361 continuously extending from the ribs 313, it is possible to realize the increase of the air intake quantity by the peripheral low portion 315 while suppressing any reduction of the strength of the housing 3 in the vicinity of the connection areas of the ribs 313 and the peripheral portion 314. Further, since the upper surface 374 of the motor fixing portion 312 and the upper surfaces of the ribs 313 are flush with each other, it is possible to increase the strength of the housing 3 in the vicinity of the connection areas of the ribs 313 and the motor fixing portion 312.

In the peripheral portion 314, the lower surface 381 of the peripheral high portion 316 and the lower surface 382 of the peripheral low portion 315 are flush or substantially flush with each other. This makes it possible to keep the height of the internal space of the housing 3 at the lower side of the peripheral low portion 315 the same as that at the lower side of the peripheral high portion 316. As a result, it is possible to prevent the height of the housing 3 from becoming greater. Moreover, the upper surface 371 of the peripheral high portion 316 and the upper surfaces of the ribs 313 are flush or substantially flush with each other. As compared with a case where one of the upper surface 371 of the peripheral high portion 316 and the upper surfaces of the ribs 313 is higher than the other, it is possible to prevent an increase in the height of the housing 3 while securing the strength of the peripheral high portion 316 and the ribs 313.

As stated above, the peripheral high portion 316 is arranged to continuously extend from the ribs 313 to the outer edge 317 of the upper surface portion 31. Since the outer edge 317 of the upper surface portion 31 is supported by the side wall portion 33, it is possible to increase the strength of the peripheral high portion 316. As a result, it becomes possible to further suppress a reduction in the strength of the housing 3. Further, since the peripheral high portion 316 includes the section of the outer edge 317 of the upper surface portion 31 positioned above the air discharge port 331, it is possible to restrain or prevent the air just discharged through the air discharge port 331 from flowing along the upper surface portion 31 and coming into the upper air intake ports 311.

Within the internal space of the housing 3, the flow velocity of the air at the rotational leading side of the impeller 4 is greater than the flow velocity of the air at the rotational trailing side. In the upper surface portion 31, the radial width of the peripheral low portion 315 at the rotational leading side is larger than the radial width of the peripheral low portion 315 at the rotational trailing side. Accordingly, it is possible to increase the area of the peripheral low portion 315 at the rotational leading side where the flow velocity of the air within the housing 3 is high without or substantially without any increase in the total area of the peripheral low portion 315. As a consequence, it is possible to increase the quantity of the air drawn through the upper air intake ports 311 while suppressing any reduction in the strength of the housing 3.

Figure 4:
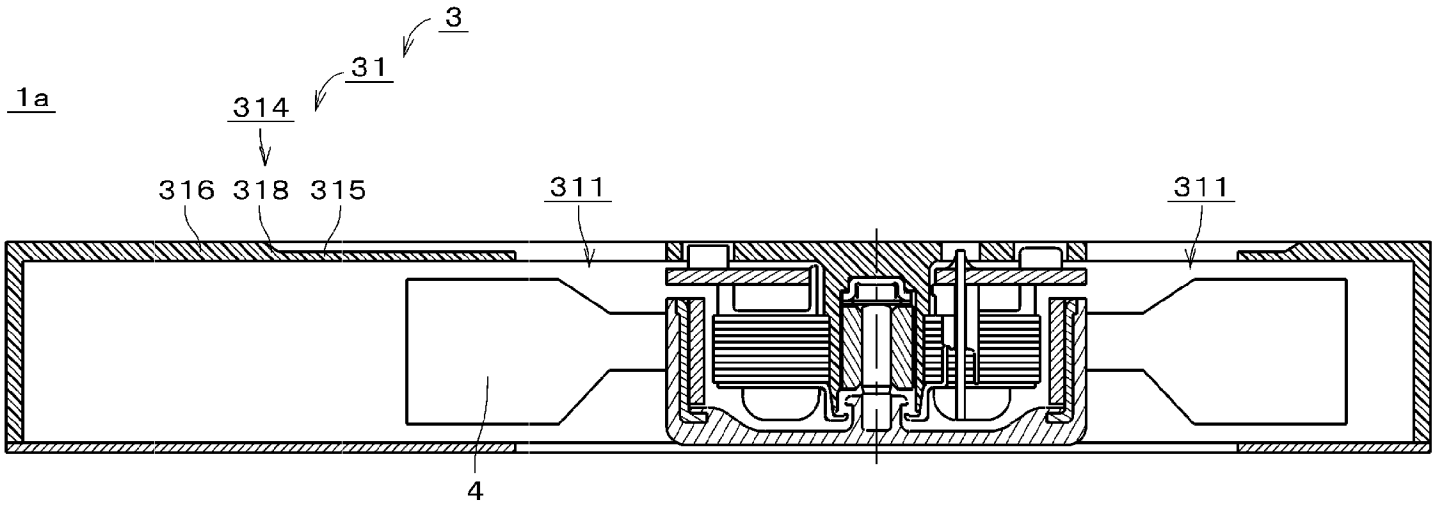
FIG. 4 is a section view showing a blower fan according to a second preferred embodiment.

FIG. 4 is a section view showing a blower fan 1*a* in accordance with a second preferred embodiment of the present invention. As shown in FIG. 4, in case of the blower fan 1*a*, the peripheral portion 314 of the upper surface portion 31 of the housing 3 further includes an intermediate portion 318 positioned between the peripheral low portion 315 and the peripheral high portion 316. Other structures of the blower fan 1*a* remain the same as those of the blower fan 1 shown in FIGS. 1 through 3 and, therefore, are designated by like reference symbols.

The intermediate portion 318 is preferably a slanted surface angled downwards from the peripheral high portion 316 toward the peripheral low portion 315, namely angled toward the impeller 4 with respect to the center axis J1. Accordingly, it is possible to smoothly guide the air toward the peripheral low portion 315 from the gap between the peripheral high portion 316 and the casing of the notebook PC. Preferably, the intermediate portion 318 will be provided in at least a portion of the boundary of the peripheral low portion 315 and the peripheral high portion 316. More preferably, the intermediate portion 318 may be provided to extend along the entire length of the boundary of the peripheral low portion 315 and the peripheral high portion 316.

Figure 5:
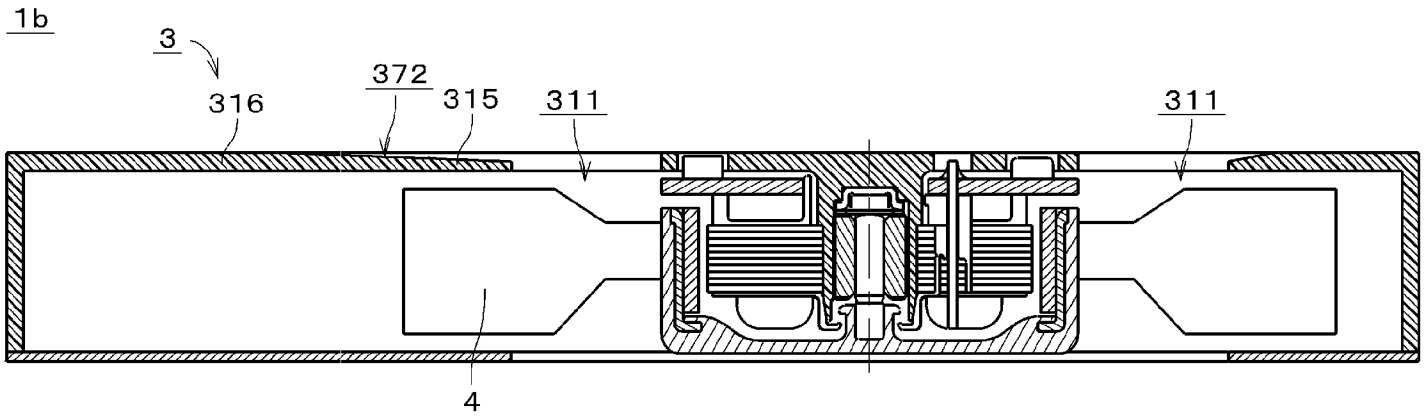
FIG. 5 is a section view showing a blower fan according to a third preferred embodiment.

FIG. 5 is a section view showing a blower fan 1*b* according to a third preferred embodiment of the present invention. As shown in FIG. 5, in case of the blower fan 1*b*, the upper surface 372 of the peripheral low portion 315 of the housing 3 is a preferably slanted surface angled downwards toward the upper air intake ports 311, namely angled toward the impeller 4 with respect to the center axis J1. Other structures of the blower fan 1*b* remain the same as those of the blower fan 1 shown in FIGS. 1 through 3 and, therefore, are designated by like reference symbols.

The thickness of the peripheral low portion 315 in the boundary of the peripheral low portion 315 and the peripheral high portion 316 is preferably equal or substantially equal to the thickness of the peripheral high portion 316. By increasing the thickness of the section of the peripheral low portion 315 closer to the peripheral high portion 316, it becomes possible to further suppress any reduction in the strength of the housing 3. In order to suppress any strength reduction of the housing 3, it is preferred that the entirety of the upper surface 372 of the peripheral low portion 315 be angled downwards toward the upper air intake ports 311. The strength reduction of the housing 3 can be at least partially suppressed if at least a portion of the upper surface 372 of the peripheral low portion 315 is angled downwards toward the upper air intake ports 311. The thickness of the peripheral low portion 315 in the boundary of the peripheral low portion 315 and the peripheral high portion 316 may be smaller than the thickness of the peripheral high portion 316.

Figure 6:
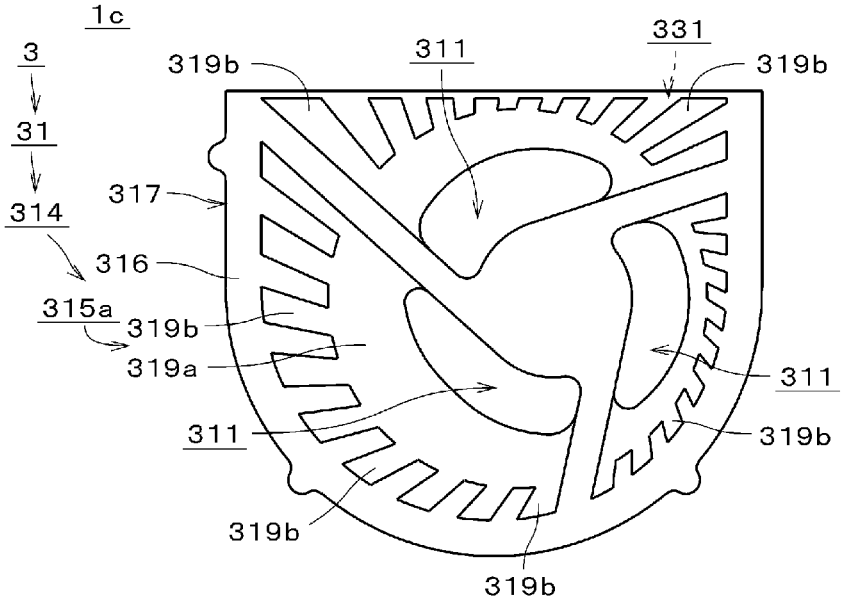
FIG. 6 is a top view showing a blower fan according to a fourth preferred embodiment.

FIG. 6 is a plan view showing a blower fan 1*c* in accordance with a fourth preferred embodiment of the present invention. As shown in FIG. 6, in case of the blower fan 1*c*, a peripheral low portion 315*a* differing in shape from the peripheral low portion 315 shown in FIG. 2 is provided in the peripheral portion 314 of the upper surface portion 31. Other structures of the blower fan 1*c* remain the same as those of the blower fan 1 shown in FIGS. 1 through 3 and, therefore, are designated by like reference symbols. In FIG. 6, the internal structures such as the impeller 4 are removed for clarity. This also holds true for all of FIGS. 7 through 12.

The peripheral low portion 315*a* preferably includes an annular low portion 319*a* and a plurality of groove portions 319*b*. The annular low portion 319*a* preferably has a substantially annular shape and substantially surrounds the outer peripheries of the upper air intake ports 311. The groove portions 319*b* extend radially outwards from the annular low portion 319*a* in a radial pattern. The portions interposed between the adjoining groove portions 319*b* are portions of the peripheral high portion 316. The provision of the groove portions 319*b* makes it possible to increase the area of the peripheral low portion 315*a* and to increase the quantity of the air drawn through the upper air intake ports 311, while suppressing the strength reduction of the housing 3.

In the peripheral portion 314, the groove portions 319*b* do not reach the outer edge 317 of the upper surface portion 31. The entirety of the outer edge 317 of the upper surface portion 31 is included in the peripheral high portion 316. This makes it possible to further suppress the strength reduction of the housing 3. Further, since the peripheral high portion 316 includes the section of the outer edge 317 of the upper surface portion 31 positioned above the air discharge port 331, it is possible to restrain or prevent the air that has just been discharged through the air discharge port 331 from being suctioned into the upper air intake ports 311.

Figure 7:
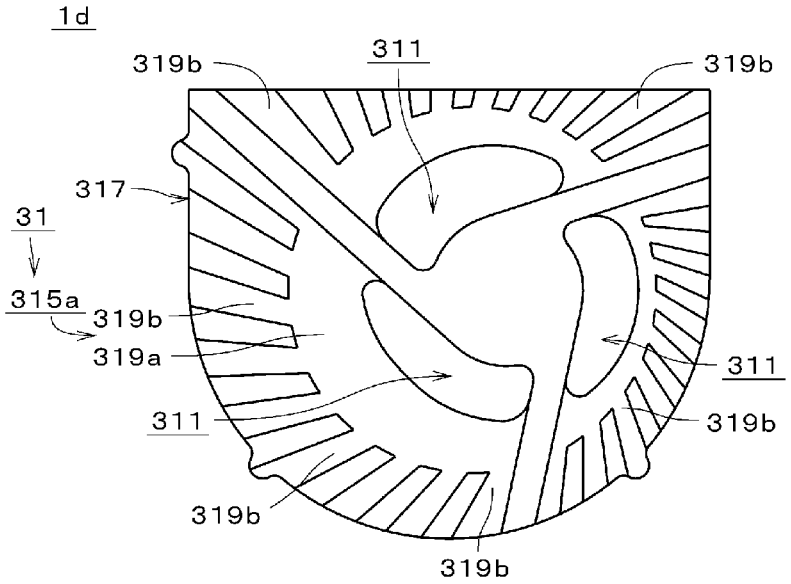
FIG. 7 is a top view showing a blower fan according to a fifth preferred embodiment.
Figure 8:
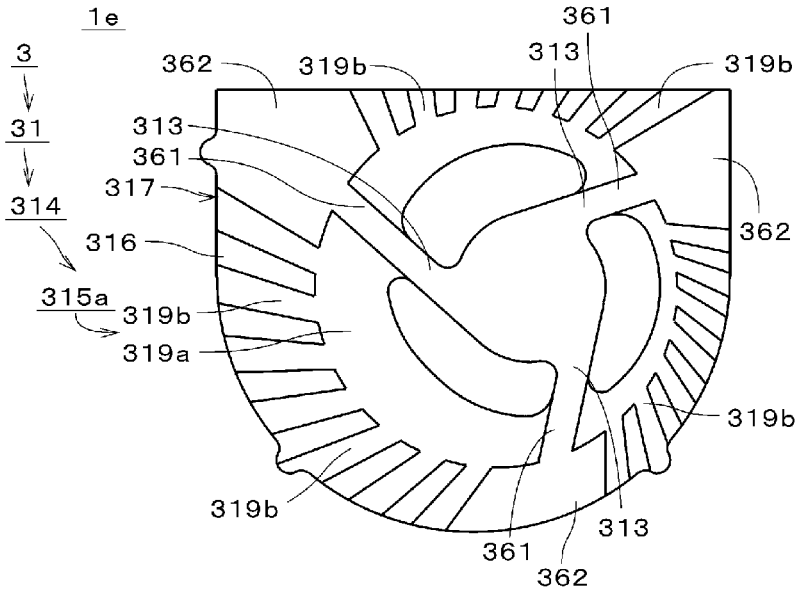
FIG. 8 is a top view illustrating a modified example of the blower fan.

FIG. 7 is a plan view showing a blower fan 1*d* in accordance with a fifth preferred embodiment of the present invention. As shown in FIG. 7, in case of the blower fan 1*d*, the peripheral low portion 315*a* preferably includes an annular low portion 319*a* and a plurality of groove portions 319*b*. The groove portions 319*b* preferably continuously extend from the annular low portion 319*a* to the outer edge 317 of the upper surface portion 31. Other structures of the blower fan 1*d* remain the same as those of the blower fan 1*c* shown in FIG. 6, and therefore, are designated by like reference symbols.

In the blower fan 1*d*, the air can be easily guided from the outer edge 317 of the upper surface portion 31 to the annular low portion 319*a* through the groove portions 319*b*. Accordingly, it is possible to further increase the quantity of the air drawn through the upper air intake ports 311.

FIGS. 8 through 12 are top views illustrating certain modified examples of the blower fans set forth above. In case of a blower fan 1*e* illustrated in FIG. 8, increased width portions 362 each having a relatively-large circumferential width are provided in the peripheral high portion 316 between the respective rib extension portions 361 and the outer edge 317 of the upper surface portion 31. Other structures remain the same as those of the blower fan 1*d* shown in FIG. 7. The increased width portions 362 are arranged to continuously extend from the rib extension portions 361 to the outer edge 317 of the upper surface portion 31. The circumferential width of the three increased width portions 362 is preferably about three to about five times as great as the width of the groove portions 319*b* of the peripheral low portion 315*a* or the width of the sections of the peripheral high portion 316 between the adjoining groove portions 319*b*. The arrangement of the increased width portions 362 makes it possible to further suppress any strength reduction of the housing 3 near the connection portions of the ribs 313 and the peripheral portion 314.

Figure 9:
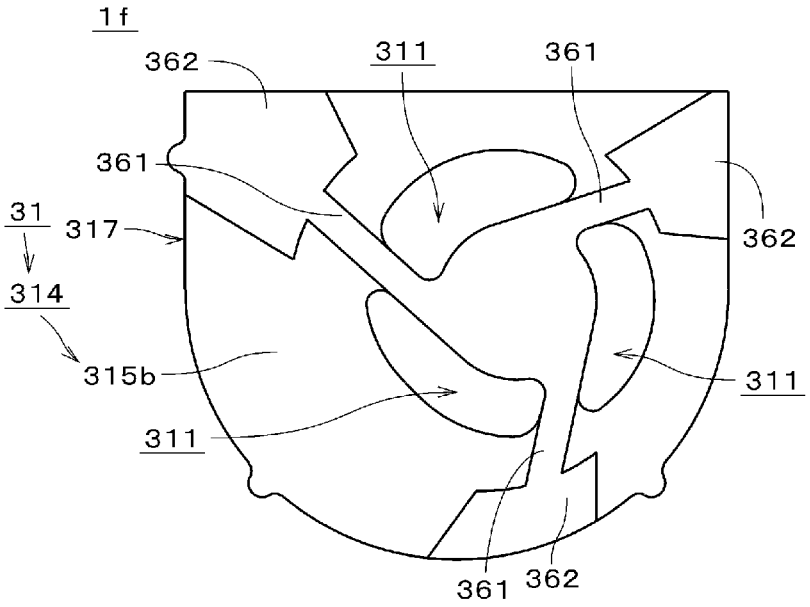
FIG. 9 is a top view illustrating another modified example of the blower fan.

In case of the blower fan 1*f* illustrated in FIG. 9, a peripheral low portion 315*b* does not include the three rib extension portions 361 and the three increased width portions 362. If the width of the peripheral low portion 315*b* continuously extending from the outer peripheries of the upper air intake ports 311 to the outer edge 317 of the upper surface portion 31 is increased in this manner, it is possible to further increase the quantity of the air drawn through the upper air intake ports 311.

Figure 10:
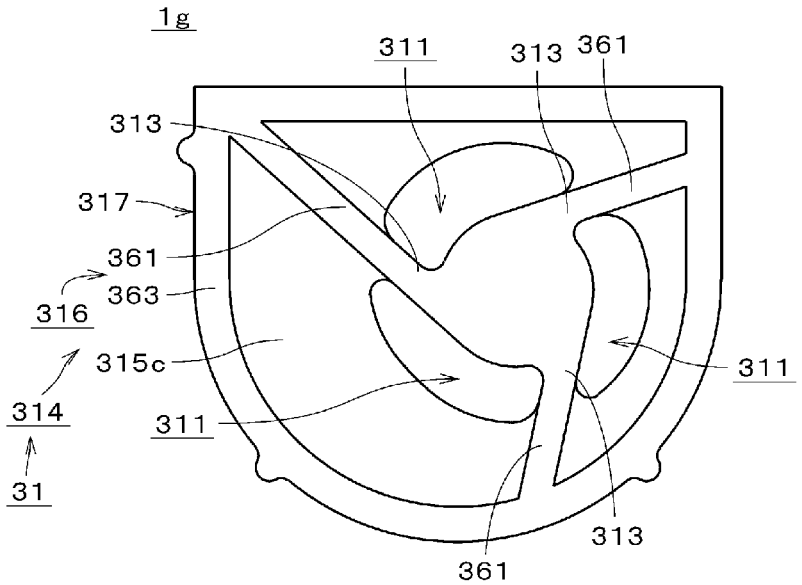
FIG. 10 is a top view illustrating a further modified example of the blower fan.

In case of the blower fan 1*g* illustrated in FIG. 10, the peripheral high portion 316 preferably includes an outer peripheral portion 363 and three rib extension portions 361. The outer peripheral portion 363 is preferably a substantially annularly-shaped portion extending along the entire length of the outer edge 317 of the upper surface portion 31. The width of the outer peripheral portion 363 is preferably constant or substantially constant over the entire length thereof. The rib extension portions 361 have a substantially band-like shape and continuously extend from the ribs 313 to the outer peripheral portion 363. In the peripheral portion 314, the portions other than the outer peripheral portion 363 and the three rib extension portions 361 define a peripheral low portion 315*c*. In the blower fan 1*g*, the strength of the peripheral high portion 316 can be enhanced by the outer peripheral portion 363. Moreover, the quantity of the air drawn through the upper air intake ports 311 can be further increased by increasing the area of the peripheral low portion 315*c*. In addition, the arrangement of the outer peripheral portion 363 makes it possible to restrain or prevent the air just discharged through the air discharge port 331 from being suctioned into the upper air intake ports 311.

Figure 11:
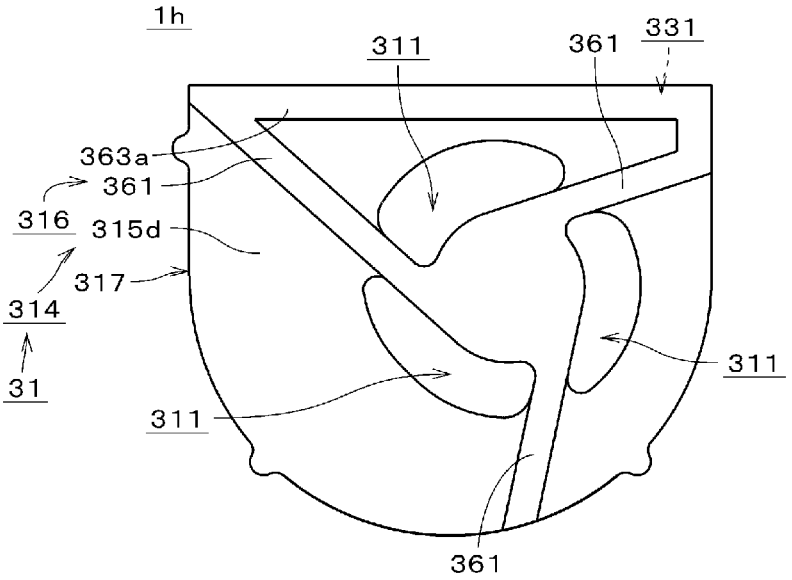
FIG. 11 is a top view illustrating a still further modified example of the blower fan.

In case of the blower fan 1*h* illustrated in FIG. 11, an outer peripheral portion 363*a* is preferably provided only in the section of the outer edge 317 of the upper surface portion 31 between the two rib extension portions 361 interposing the air discharge port 331 therebetween when seen in a plan view. In the peripheral portion 314, the outer peripheral portion 363*a* and the three rib extension portions 361 define a peripheral high portion 316. All the remaining portions define a peripheral low portion 315*d*. In the peripheral low portion 315*d* of the blower fan 1*h*, the quantity of the air drawn through the upper air intake ports 311 can be further increased by increasing the width of the portions continuously extending from the outer peripheries of the upper air intake ports 311 to the outer edge 317 of the upper surface portion 31. In addition, the arrangement of the outer peripheral portion 363*a* makes it possible to restrain or prevent the air just discharged through the air discharge port 331 from being suctioned into the upper air intake ports 311.

Figure 12:
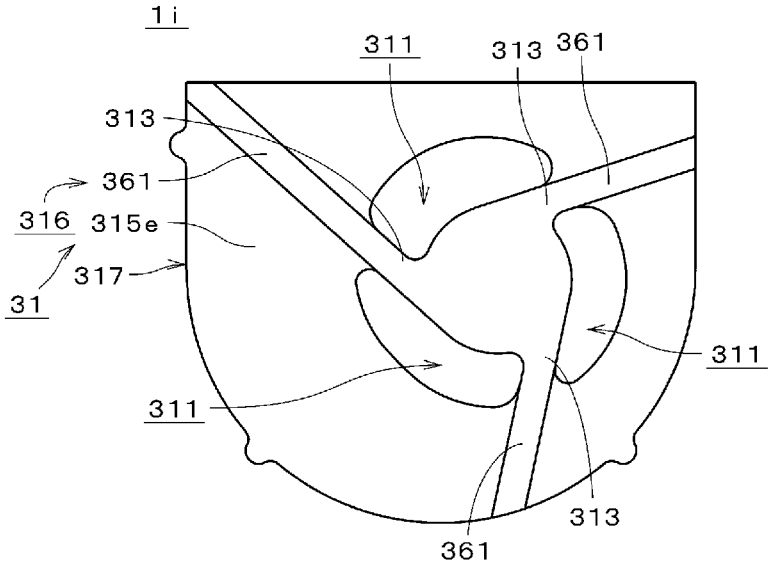
FIG. 12 is a top view illustrating a yet still further modified example of the blower fan.

In case of the blower fan 1*i* illustrated in FIG. 12, the three band-like rib extension portions 361 extending from the three ribs 313 to the outer edge 317 of the upper surface portion 31 define a peripheral high portion 316. All the remaining portions define a peripheral low portion 315*e*. In the peripheral low portion 315*e*, the quantity of the air drawn through the upper air intake ports 311 can be further increased by increasing the width of the portions continuously extending from the outer peripheries of the upper air intake ports 311 to the outer edge 317 of the upper surface portion 31.

While certain preferred embodiments of the present invention have been described above, the present invention is not limited to these preferred embodiments but may be modified in many different forms.

For example, the peripheral high portion 316 need not always extend from the ribs 313 to the outer edge 317 of the upper surface portion 31 so long as the strength of the housing 3 can be kept within a predetermined permissible range. The upper surface 371 of the peripheral high portion 316 and the upper surfaces of the ribs 313 may be positioned at different elevations along the center axis J1. Likewise, the lower surface 381 of the peripheral high portion 316 and the lower surface 382 of the peripheral low portion 315 may be positioned at different elevations along the center axis J1.

While the upper air intake ports 311 and the lower air intake port 321 are provided in the housing 3 in the preferred embodiments of the blower fans 1 and 1*a* through 1*i*, just the upper air intake ports 311 may be provided depending on the use of the blower fan. The number of the upper air intake ports 311 may be two or four or more. The number of the ribs 313 may be properly changed to be any desirable number depending on the number of the upper air intake ports 311.

The center axis J1 of the motor 2 and the impeller 4 may be arranged substantially in the same position as the center of the air discharge port 331 in the transverse extension direction of the air discharge port 331. The peripheral low portion 315 of the blower fan 1 shown in FIG. 2 may be arranged so that the center thereof can substantially coincide with the center axis J1 when seen in a plan view. In the blower fan 1*c* shown in FIG. 6 and in the blower fan 1*d* shown in FIG. 7, the center of the annular low portion 319*a* may be arranged to substantially coincide with the center axis J1 when seen in a plan view.

The configurations of the preferred embodiments and the modified examples described above may be appropriately combined unless contradictory to one another.

The blower fan of the present invention can be used in cooling components within a casing of a notebook PC or a desktop PC, cooling other devices or supplying an air to different kinds of objects. It is also possible to use the blower fan in other applications.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A blower fan, comprising:

an impeller arranged to rotate about a center axis;

a motor arranged to rotate the impeller about the center axis; and a housing arranged to accommodate the impeller; wherein the housing includes an upper surface portion arranged to cover an upper surface of the impeller, a lower surface portion arranged to cover a lower surface of the impeller, and a side wall portion arranged to cover a side surface of the impeller and having an air discharge port;

the upper surface portion includes a motor fixing portion to which the motor is fixed, a peripheral portion positioned around the motor fixing portion, and a plurality of ribs interconnecting the motor fixing portion and the peripheral portion, the upper surface portion including a plurality of air intake ports defined between the motor fixing portion, the peripheral portion, and the plurality of ribs and being arranged to oppose the impeller; and the peripheral portion includes a peripheral low portion arranged to substantially surround outer peripheries of the plurality of air intake ports and positioned lower than upper surfaces of the plurality of ribs and a peripheral high portion that is provided with rib extension portions continuously extending from the plurality of ribs and positioned higher than an upper surface of the peripheral low portion.

2. The blower fan of claim 1, wherein a lower surface of the peripheral low portion is flush or substantially flush with a lower surface of the peripheral high portion.

3. The blower fan of claim 1, wherein an upper surface of the peripheral high portion is flush or substantially flush with the upper surfaces of the plurality of ribs.

4. The blower fan of claim 1, wherein the upper surfaces of the plurality of ribs are flush or substantially with, and extend continuously from, an upper surface of the motor fixing portion.

5. The blower fan of claim 1, wherein the peripheral high portion includes a section of an outer edge of the upper surface portion positioned above the air discharge port.

6. The blower fan of claim 1, wherein the peripheral high portion includes an entire outer edge of the upper surface portion.

7. The blower fan of claim 1, wherein the peripheral portion further includes an intermediate portion arranged between the peripheral low portion and the peripheral high portion, the intermediate portion including an upper surface angled downwards from the peripheral high portion toward the peripheral low portion.

8. The blower fan of claim 1, wherein at least a portion of the upper surface of the peripheral low portion is a slanted surface angled downwards toward the air intake ports.

9. The blower fan of claim 1, wherein the radial distance between an inner surface of the side wall portion and the impeller at a rotational trailing side of the impeller is smaller than the radial distance between an inner surface of the side wall portion and the impeller at a rotational leading side of the impeller; and the radial width of the peripheral low portion at the rotational leading side of the impeller is greater than the radial width of the peripheral low portion at the rotational trailing side of the impeller.

10. The blower fan of claim 1, wherein the lower surface portion of the housing includes a lower air intake port arranged to oppose the impeller.

11. The blower fan of claim 1, wherein the peripheral low portion includes an annular low portion substantially surrounding the outer peripheries of the plurality of air intake ports and a plurality of groove portions extending radially outwards from the annular low portion in a radial pattern.

12. The blower fan of claim 1, wherein the peripheral low portion includes an annular low portion substantially surrounding the outer peripheries of the plurality of air intake ports and a plurality of groove portions extending radially outwards from the annular low portion in a radial pattern, the groove portions extending continuously from the annular low portion to an outer edge of the upper surface portion.

13. The blower fan of claim 12, wherein the peripheral high portion includes increased width portions having an increased width in at least a portion thereof in a peripheral direction.

14. The blower fan of claim 13, wherein the increased width portions are provided between the rib extension portions and the outer edge of the upper surface portion.

15. The blower fan of claim 1, wherein the peripheral low portion includes an annular low portion substantially surrounding the outer peripheries of the plurality of air intake ports, the upper surface portion including an outer edge including the peripheral low portion and the peripheral high portion.

16. The blower fan of claim 15, wherein the peripheral high portion includes increased width portions having an increased width in at least a portion thereof in a peripheral direction.

17. The blower fan of claim 1, wherein the peripheral high portion includes an outer peripheral portion, which extends along the entire length of an outer edge of the upper surface portion, and the rib extension portions, the width of the outer peripheral portion being substantially constant along the overall length thereof.

18. The blower fan of claim 17, wherein the outer peripheral portion is provided only at positions between the rib extension portions interposing the air discharge port therebetween.

* * * * *